US007065313B2

(12) United States Patent
Matsumoto et al.

(10) Patent No.: US 7,065,313 B2
(45) **Date of Patent: *Jun. 20, 2006**

(54) DEVELOPER CONTAINER, DEVELOPER REPLENISHING DEVICE USING THE SAME AND IMAGE FORMING APPARATUS INCLUDING THE SAME

(75) Inventors: Junichi Matsumoto, Kanagawa (JP); Nobuo Kasahara, Kanagawa (JP); Nobuo Iwata, Kanagawa (JP); Satoshi Muramatsu, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/095,513

(22) Filed: Apr. 1, 2005

(65) Prior Publication Data

US 2005/0180782 A1 Aug. 18, 2005

Related U.S. Application Data

(63) Continuation of application No. 10/454,689, filed on Jun. 5, 2003, now Pat. No. 6,898,405.

(30) Foreign Application Priority Data

Jun. 5, 2002 (JP) ..... 2002-164422

(51) Int. Cl.
*G03G 15/08* (2006.01)

(52) U.S. Cl. ..... 399/262; 399/258

(58) Field of Classification Search ..... 399/107, 399/119, 258, 262; 222/DIG. 1
See application file for complete search history.

(56) References Cited

U.S. PATENT DOCUMENTS

| | | | | |
|---|---|---|---|---|
| 4,984,023 | A | 1/1991 | Yoshida | |
| 5,594,535 | A | 1/1997 | Beaufort et al. | |
| 5,655,181 | A | 8/1997 | Chadani et al. | |
| 5,960,238 | A | 9/1999 | Ohgami | |
| 6,532,352 | B1 | 3/2003 | Katsuyama | |
| 6,571,076 | B1 | 5/2003 | Kasahara et al. | |
| 6,898,405 | B1 * | 5/2005 | Matsumoto et al. | 399/262 |
| 2001/0052526 | A1 * | 12/2001 | Kasahara et al. | 222/DIG. 1 X |

FOREIGN PATENT DOCUMENTS

| | | |
|---|---|---|
| JP | 03-077961 | 8/1991 |
| JP | 06-161245 | 6/1994 |
| JP | 08-123171 | 5/1996 |
| JP | 08-272204 | 10/1996 |
| JP | 11-119536 | 4/1999 |
| JP | 2002-002833 | 1/2002 |
| JP | 2003-043797 | 2/2003 |

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A developer replenishing device included in an image forming apparatus of the present invention replenishes a developer from a developer container to a developing device and allows the developer container to decrease in volume when air or the developer is discharged from the developer container. A holder holds the developer container mounted thereto. A regulating device regulates the shape of the developer container when the volume of the developer container decreases.

18 Claims, 7 Drawing Sheets

DEVELOPER CONTAINER, DEVELOPER REPLENISHING DEVICE USING THE SAME AND IMAGE FORMING APPARATUS INCLUDING THE SAME

CROSS-REFERENCE TO RELATED APPLICATIONS

This application is a continuation of U.S. application Ser. No. 10/454,689, filed Jun. 5, 2003, now U.S. Pat. No. 6,898,405 and is based upon and claims the benefit of priority from the prior Japanese Patent Application No. 2002-164422, filed Jun. 5, 2002, the entire contents of each of which are incorporated herein by reference.

BACKGROUND OF THE INVENTION

1. Field of the Invention

The present invention relates to a method of causing a developer container to decrease in volume in substantially a preselected shape, a developer replenishing device using the developer container, and an image forming apparatus including the same.

2. Description of the Background Art

It is a common practice with a printer, copier, facsimile apparatus or similar image forming apparatus to form a toner image with a developer stored in a developing unit and implemented as only toner or a toner and carrier mixture. Generally, because toner is consumed as image formation is repeated, a toner bottle, toner cartridge or similar toner container, storing fresh toner therein, is removably mounted to the apparatus body for replenishing the fresh toner to the developing unit. To discharge toner from such a toner container, an auger may be disposed in the toner container for conveying the toner to the outlet of the container. Alternatively, the toner container may be implemented as a screw bottle rotatable about its axis to convey toner toward an outlet little by little.

The auger scheme is, however, not practicable without a rotatable member disposed in the toner container, resulting in a sophisticated structure. In addition, the rotatable member, which needs replacement, increases the cost of the toner container. On the other hand, the screw bottle scheme is simple because no members are present in the bottle. However, because the screw bottle is formed with an outlet at one side thereof and positioned substantially horizontally, it can accommodate only a relatively small amount of toner and is slippery and difficult to hold by hand in the event of replacement.

In light of the above, there has been proposed a toner conveying system in which a suction pump sucks toner out of a toner container and delivers it to any desired position. This system allows the toner container to be implemented as a container that is flexible and therefore foldable in a compact configuration after use. The toner container thus folded up can be collected by the manufacturer at low cost.

The flexible toner container stated above can decrease in volume in accordance with the consumption of the toner stored therein. Also, when such a toner container runs out of toner, its volume can be reduced if air inside the container is sucked out. The toner container reduced in volume is easy to handle at the time of replacement and does not have to be folded up later, contributing to the reduction of collection cost.

However, the problem with the flexible toner container is that the container cannot decrease in volume in a preselected shape due to collapse, twist and so forth. It follows that even the toner container reduced in volume cannot be efficiency stored or transported after collection. Should the toner container reduced in volume be neatly folded later, extra work would be required and would therefore cancel the advantage of a decrease in volume. Moreover, it is likely that much toner is left in the toner container because of such an irregular decrease in volume.

Technologies relating to the present invention are disclosed in, e.g., Japanese Patent Laid-Open Publication Nos. 8-272204 and 2003-43797.

SUMMARY OF THE INVENTION

It is an object of the present invention to provide a method of reducing the volume of a flexible developer or toner container in substantially a preselected shape.

It is another object of the present invention to provide a developer replenishing device using the above developer container and an image forming apparatus including the developer replenishing device.

A developer replenishing device included in an image forming apparatus of the present invention replenishes a developer from a developer container to a developing device and allows the developer container to decrease in volume when air or the developer is discharged from the developer container. A holder holds the developer container mounted thereto. A regulating device regulates the shape of the developer container when the volume of the developer container decreases.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
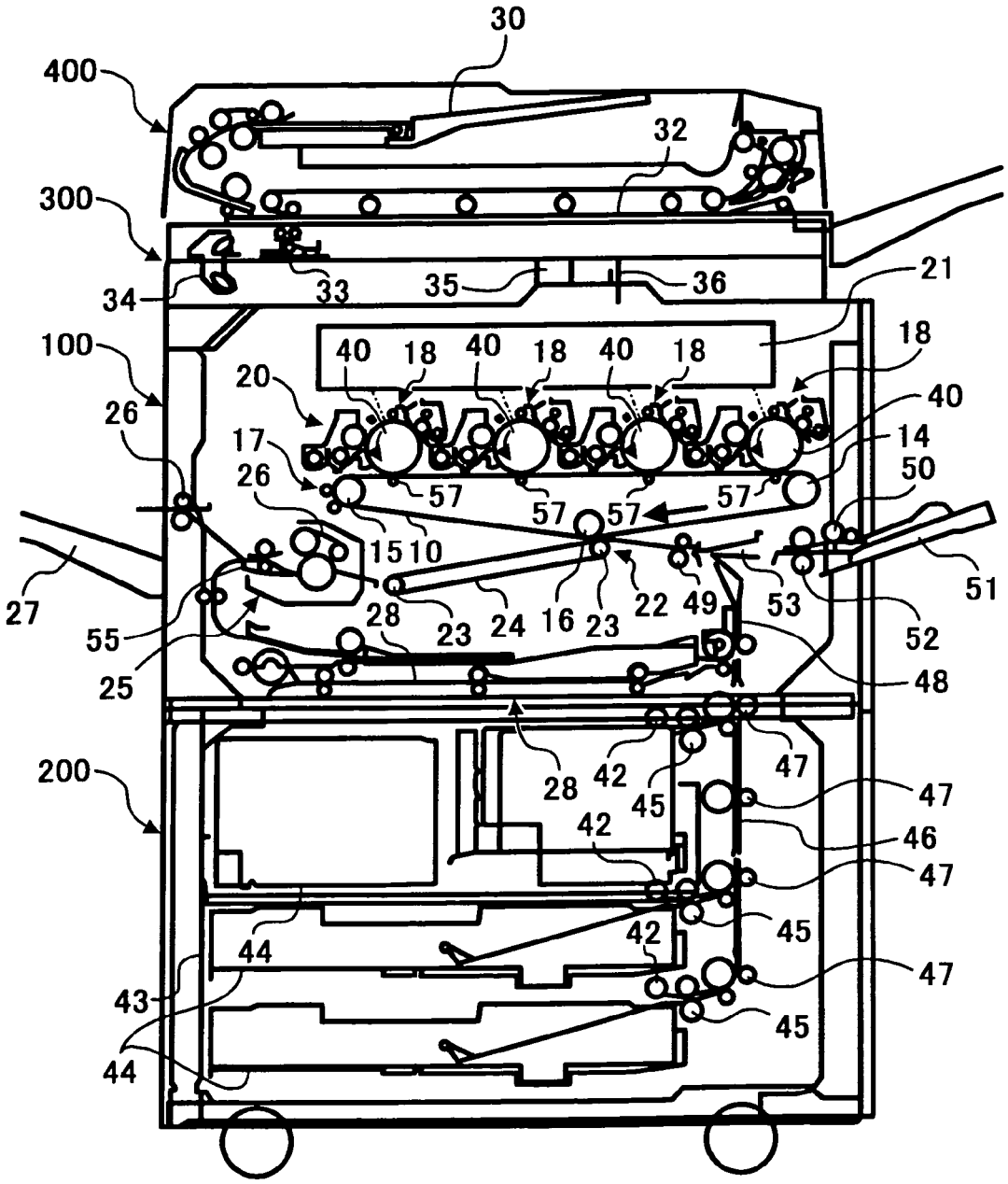
FIG. 1 is a view showing the general construction of an image forming apparatus to which the present invention is applied.

Referring to FIG. 1 of the drawings, an image forming apparatus to which the present invention is applied is shown and implemented as a color copier by way of example. As shown, the color copier is generally made up of a copier body 100, a sheet feed table 200 on which the copier body 100 is mounted, a scanner 300 positioned on the top of the copier body 100, and an ADF (Automatic Document Feeder) mounted on the top of the scanner 300.

An endless, flexible, intermediate image transfer belt or image carrier 10 is disposed in the copier body 100 and passed over a plurality of rollers 14, 15 and 16. One of the rollers 14 through 16 is implemented as a drive roller to be driven by a drive source, not shown, so that the intermediate image transfer belt (simply belt hereinafter) 10 is movable clockwise, as indicated by an arrow in FIG. 1. The other rollers are rotated by the belt 10. Four image forming units 18 are arranged side by side along the upper run of the belt 10, i.e., between the rollers 14 and 15, and each is assigned to one of black, cyan, magenta and yellow. The image forming units 18 constitute a tandem, image forming section.

Each image forming unit 18 includes a respective photoconductive drum or image carrier 40 held in contact with the belt 10. Arranged around the drum 40 are a charger, a developing unit, a cleaning unit, a quenching lamp and other conventional electrophotographic process units. Primary image transferring units 57 are positioned between the opposite runs of the belt 10, and each faces one of the drums 40. In the illustrative embodiment, the image forming units 18 are identical in configuration except for the color of toner to use.

An optical writing unit 21 is positioned above the image forming units 18 and scans each of the drums 40 with a laser beam in accordance with particular image data at a position between the charger and the developing unit. While a particular writing unit may be assigned to each image forming unit 18, the writing unit 21 shared by all of the image forming units 18 is desirable from the cost standpoint.

A secondary image transferring unit 22, as distinguished from the primary image transferring units 57, is positioned at the opposite side to the image forming section 20 with respect to the belt 10. The secondary image transferring unit 22 includes an endless, secondary image transfer belt (simply belt hereinafter) 24 passed over rollers 23 and pressed against a roller 16 via the belt 10. A fixing unit 25 is positioned at the left-hand side of the secondary image transferring unit 22, as viewed in FIG. 1, for fixing a toner image transferred to a sheet or recording medium.

The secondary image transferring device 22 serves to convey the sheet carrying the toner image thereon to the fixing unit 25 as well. Of course, the secondary image transferring device 22 may be implemented as a non-contact type charger, in which case an extra sheet conveying device will be required.

In the illustrative embodiment, a sheet turning unit 28 is positioned below the secondary image transferring unit 22 and fixing unit 25 in parallel to the image forming section 20. In a duplex copy mode, the sheet turning unit 28 turns back the sheet, so that images can be formed on both sides of the sheet.

In operation, the operator stacks documents on a document tray 30 included in the ADF 400 or opens the ADF 400, lays a single document on a glass platen 32 included in the scanner 300, and then closes the ADF 400. Subsequently, when the operator presses a start switch, not shown, the scanner 300 is driven after one document has been conveyed from the ADF 400 to the glass platen 32 or driven immediately when a single document is laid on the glass platen 32, causing a first and a second carriage 33 and 34 to move. A light source mounted on the first carriage 33 illuminates the document positioned on the glass platen 32. The resulting imagewise reflection from the document is reflected toward the second carriage 34, reflected by a mirror mounted on the second carriage 34, and then incident to an image sensor 36 via a lens 35. The image sensor 36 photoelectrically transduces the incident light.

On the turn-on of the start switch, the belt 10 is caused to start moving while the drums 40 of the image forming units 18 are caused to start rotating to form a black, a yellow, a magenta and a cyan toner image thereon. Such toner images are sequentially transferred from the drums 40 to the belt 10 one above the other, completing a composite color image on the belt 10.

The sheet feed table or sheet feeding section 200 accommodates a paper bank 43 including a stack of sheet cassettes 44. On the turn-on of the start switch, a pickup roller 42 assigned to one of the sheet cassettes 44 selected is rotated to pay out a single sheet toward a path 46. At this instant, a reverse roller 45 prevents the other sheets underlying the above sheet from being paid out together. Roller pairs 47 convey the sheet along the path 46 to a path 48 disposed in the copier body 100 until the leading edge of the sheet abuts against the nip of a registration roller pair 49.

On the other hand, when the operator stacks documents on a manual feed tray 51, a pickup roller 50 assigned to the manual feed tray 51 pays out one document from the stack at a time in cooperation with a reverse roller 52 to a path 53. The path 53 also terminates at the registration roller pair 49.

The registration roller pair 49 once stops the sheet to correct its skew and then starts conveying the sheet at such timing that the leading edge of the sheet meets the leading edge of the composite color image formed on the belt 10 at a nip between the belt 10 and the secondary image transferring unit 22. As a result, the color image is transferred from the belt 10 to the sheet by the secondary image transferring device 22, completing a full-color image.

Subsequently, the secondary image transferring device conveys the sheet, which carries the full-color image thereon, to the fixing unit 25. The fixing unit 25 fixes the image on the sheet with heat and pressure. Subsequently, a path selector 55 steers the sheet coming out of the fixing unit 25 toward an outlet roller pair 26, so that the sheet is driven out of the copier body 100 and stacked on a copy tray 27. In the duplex copy mode, the path selector 55 steers the above sheet toward the sheet turning unit 28. The sheet turning unit 28 turns back the sheet and again delivers it toward the nip between the between the belt 10 and the secondary image transferring unit 22. Consequently, another full-color image is formed on the other side of the same sheet. The sheet or duplex copy is then driven out to the copy tray 27 via the outlet roller pair 26.

After the image transfer, a cleaning unit 17 assigned to the belt 10 removes toner left on the belt 10 to thereby prepare the belt 10 for the next image forming cycle.

Figure 2:
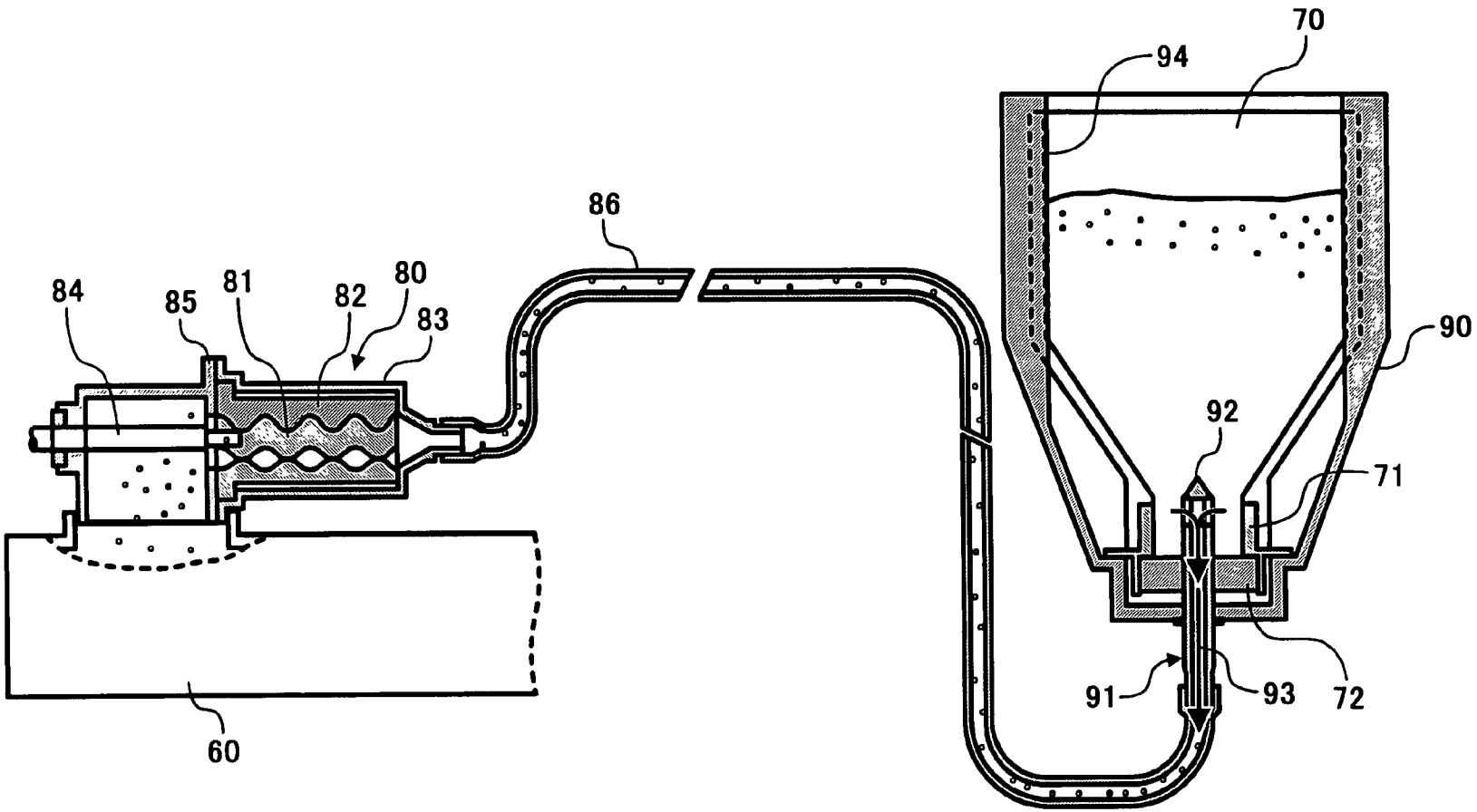
FIG. 2 is a section showing a toner replenishing device included in the apparatus of FIG. 1 and embodying the present invention.

FIG. 2 shows a toner replenishing device as a specific form of a developer replenishing device in accordance with the present invention. In FIG. 2, the reference numeral 60 designates the developing unit mentioned earlier and stores a two-ingredient type developer, i.e., a toner and carrier mixture. Because the toner of the developer is consumed due to repeated development, it is necessary to replenish fresh toner to the developing unit 60. While various schemes have heretofore been proposed for controlling toner replenishment, it is a common practice to sense the toner and carrier mixture ratio or the density of a pattern image formed on the drum 1 and then output a toner replenishing signal on the basis of the mixture ratio or the density sensed.

A powder pump or uniaxial, eccentric screw pump 80 is positioned on the developing unit 60 and plays the role of sucking means for sucking fresh toner stored in a toner container 70. The powder pump 80 includes a female-screw type stator 82 formed of rubber or similar elastic material and formed with a double-pitch spiral groove and a male-screw type rotor 81 rotatably disposed in the stator 82 and formed of, e.g., metal or resin. The rotor 81 is connected to a drive shaft 84 by, e.g., a spring pin and caused to rotate by the drive shaft 84. A holder 83 is affixed to a case 85 and encloses the stator 82 with a gap being formed between the inner periphery of the holder 83 and the outer periphery of the stator 82.

The toner container 70, storing the fresh toner, is fluidly communicated to the powder pump 80 by a toner tube or delivery path 86. While the toner tube 86 should only be tubular, it should preferably be implemented as a flexible tube so as to allow the toner container 70 and developing unit 60 to be freely positioned relative to each other. This contributes a great deal to design freedom. The flexible tube may advantageously be formed of rubber highly resistant to the toner, e.g., polyurethane, nitrile or EPDM.

Figure 3:
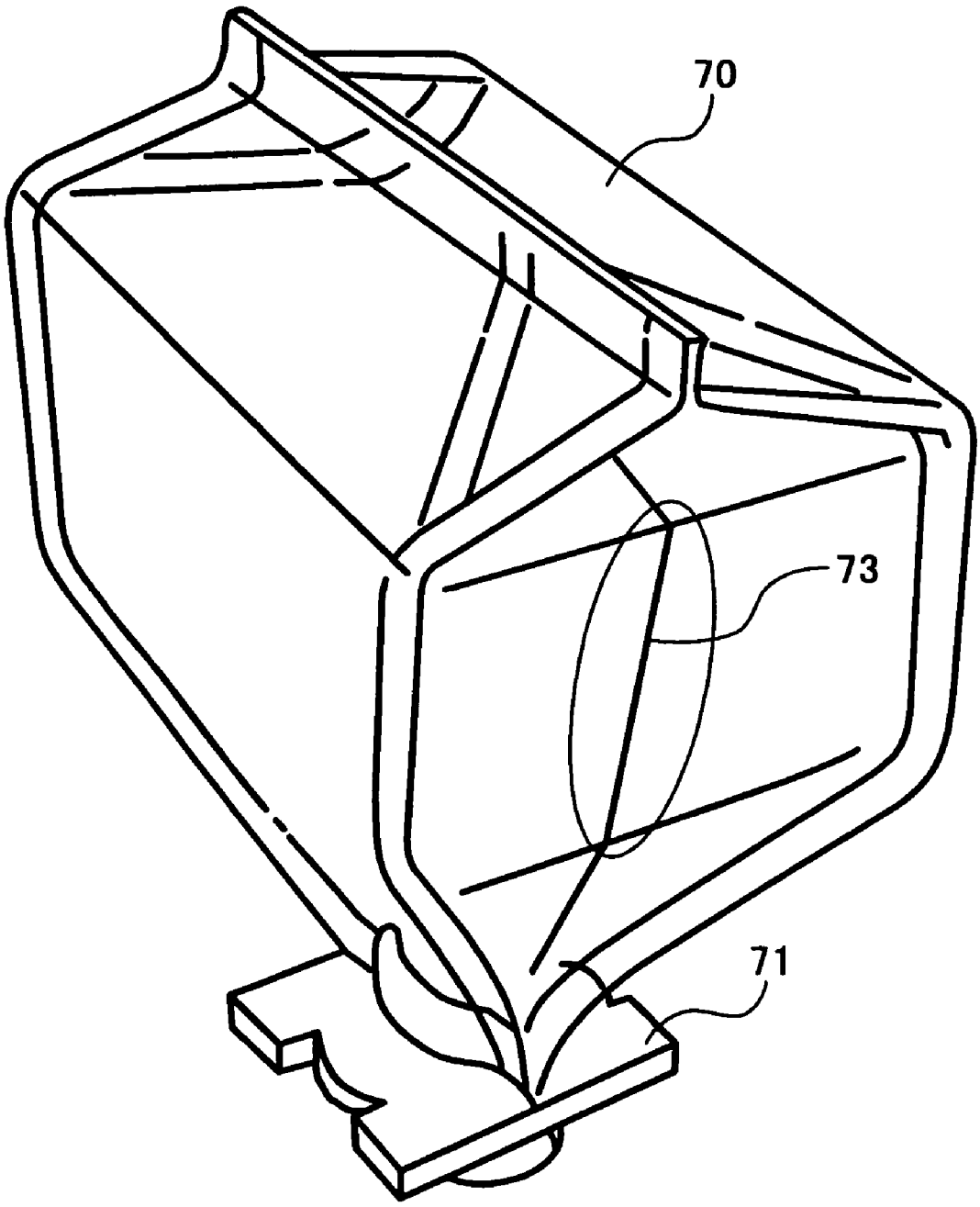
FIG. 3 is a perspective view showing a toner container for use in the toner replenishing device of FIG. 2 in a full condition.
Figure 4:
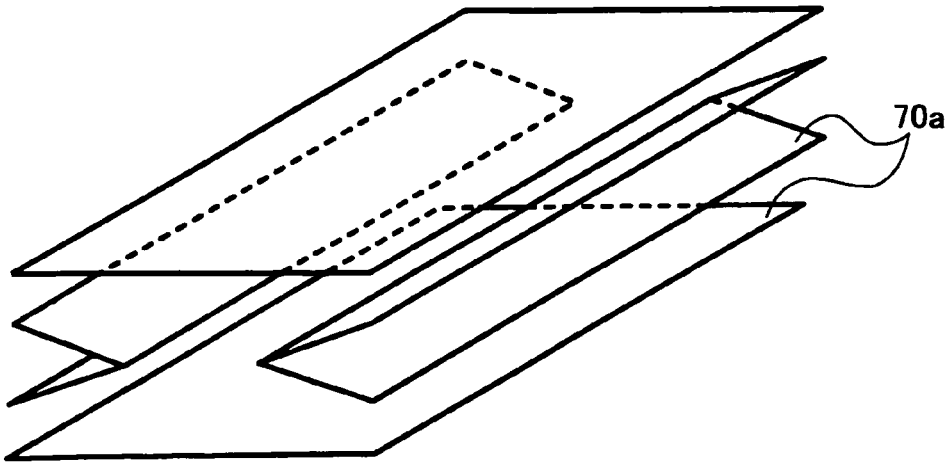
FIG. 4 is a perspective view showing the basic configuration of the toner container.
Figure 5:
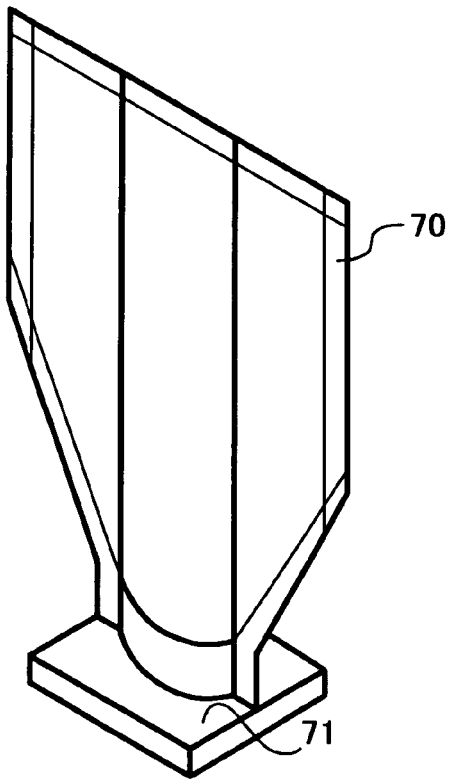
FIG. 5 is a perspective view showing the toner container in an empty condition.

In the illustrative embodiment, the toner container 70 is implemented as a bag constituted by single-layer or laminate flexible sheets formed of polyethylene, nylon or similar resin or paper and having thickness of 60 μm to 200 μm. The bag has a hermetic configuration including no air inlet/outlet. More specifically, as shown in FIG. 3, the bag is a so-called gazette container. As shown in FIG. 4, the gazette container is constituted by four sheets 70*a* whose edges are affixed to each other by heat. FIGS. 3 and 5 show the toner container in an inflated position filled with the toner and a folded or empty position, respectively. As shown in FIGS. 2 and 3, a mouth member 71 is affixed to the bottom of the toner container 70. A seal valve 72 is fitted in the mouth member 71 and formed of, e.g., sponge or rubber. A slit, not shown, is formed in the seal valve 72. While the toner container 70 is generally elongate, its lower portion is tapered toward the mouth member 71 little by little in order to promote smooth discharge of the toner and easy mounting.

The toner container 70 with the above configuration is mounted to a mount portion formed at a suitable position in the image forming apparatus. As shown in FIG. 2, the mount portion includes a holder 90 formed of resin or similar hard material for supporting the toner container 70 and a nozzle 91 to be inserted into the toner container 70 via the seal valve 71. The nozzle 91 has a toner passage 93 and a sharp tip 92, which allows the nozzle 91 to smoothly penetrate into the toner container 70.

The operation of the toner replenishing device will be described hereinafter. When the toner present in the developing device 60 is consumed, the powder pump 80 is driven to generate suction pressure. The suction pressure is transferred to the inside of the toner container 70 via the toner tube 86, so that the toner is sucked into the powder pump 80 via the nozzle 91 and toner tube 86 and then replenished to the developing device 60. At this instant, the suction pressure can be transferred to the toner without any loss if the path between the powder pump 80 and the toner container 70 is held substantially hermetic.

The toner container 70, which is a flexible bag, decreases in volume little by little in accordance with the delivery of the toner therefrom. As shown in FIG. 3, folds 73 are formed in opposite side walls of the toner container 70 and extend in the up-and-down direction. If the side walls yield inward along the folds 73, then the toner container 70 decreased in volume can be folded up in a desirable configuration shown in FIG. 5. More specifically, if the toner container 70 folds up along the folds 73, then it is free from irregular collapse or twist and allows a minimum of toner to be left therein. Further, the toner container 70 folds up substantially flat and can therefore be easily stored or transported for collection while occupying a minimum of space, contributing to cost reduction.

Figure 6:
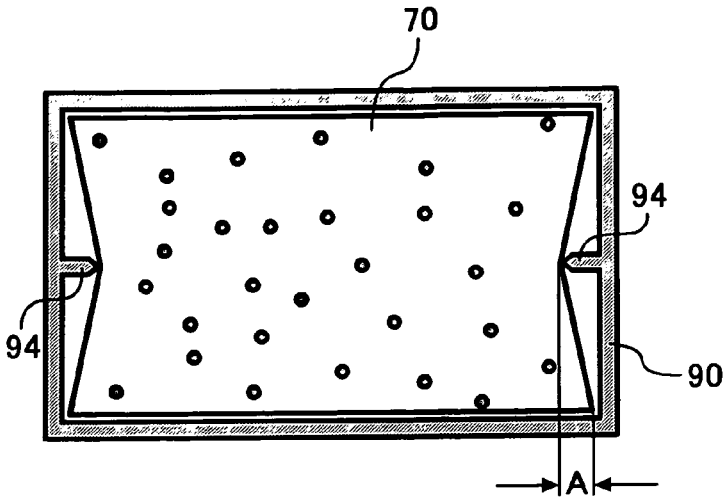
FIG. 6 is a cross-section showing the toner container.

In light of the above, as shown in FIG. 6, the toner replenishing device of the illustrative embodiment provides the holder 90, which supports the toner container 70, with lugs or regulating means 94 that bite into the folds 73 of the toner container 70. The lugs 94 each extend in the up-and-down direction like the folds 73. The lugs 94 bite into the toner container 70 by an amount of 2 mm to 20 mm. The lugs 94 formed on opposite walls of the holder 90 are more desirable than a single lug.

In the condition shown in FIG. 6, when the volume of the toner container 70 decreases little by little due to the consumption of the toner, it folds along the folds 73 by being regulated by the lugs 94 and can therefore fold up in substantially a preselected shape. While air under pressure may be fed from an air pump to the toner container 70 in order to enhance the fluidity of the toner during replenishment, such air prevents the toner container 70 from folding up when run out of the toner. In such a case, the powder pump 80 may be operated after the toner container 70 has run out of the toner, causing the toner container 70 to fold up. In this case, too, the lugs 94 allow the toner container 70 to neatly fold up in substantially the preselected position.

Figure 7:
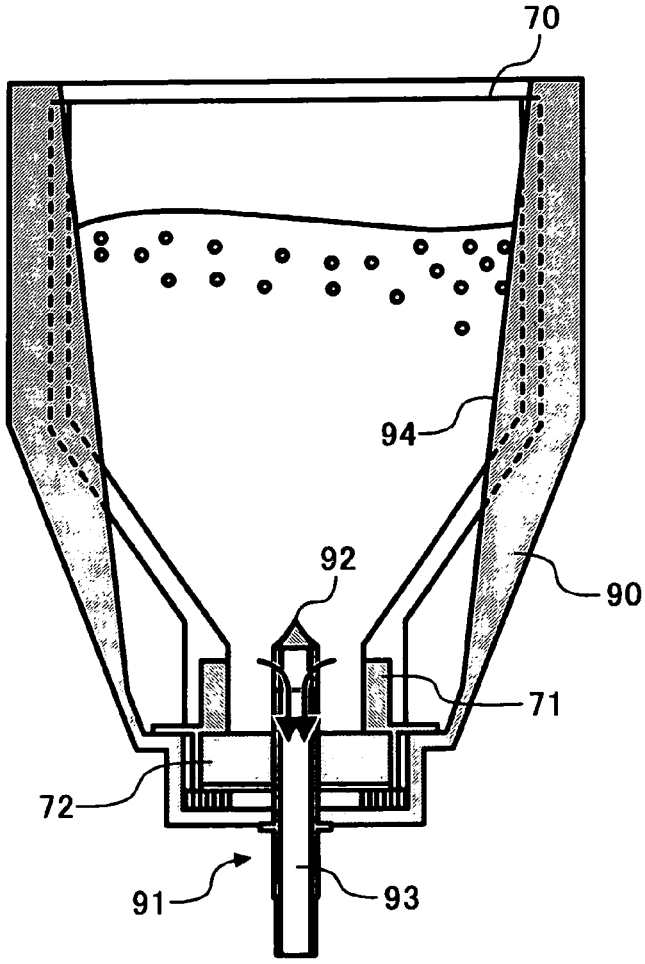
FIG. 7 is a vertical section showing an alternative embodiment of the present invention.

FIG. 7 shows an alternative embodiment of the present invention. In FIG. 7, structural elements identical with those shown in FIG. 2 are designated by identical reference numerals and will not be described specifically in order to avoid redundancy. As shown, this embodiment differs from the previous embodiment in that the lugs 94, protruding from the opposite walls of the holder 90, are tapered toward the bottom such that they approach each other little by little. This configuration not only regulates the toner container 70 when the container 70 folds up, but also allows the lugs 94 to guide the container 70 when the container 70 is mounted to the holder 90 for thereby promoting smooth mounting.

Figure 8:
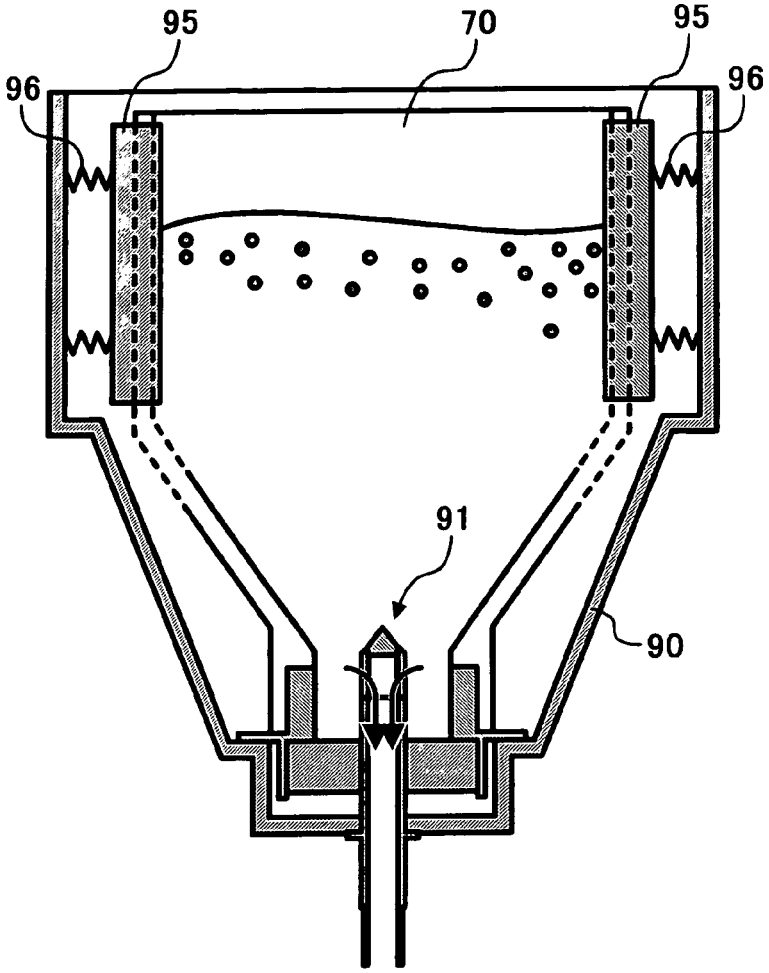
FIG. 8 is a vertical section showing another alternative embodiment of the present invention.
Figure 9:
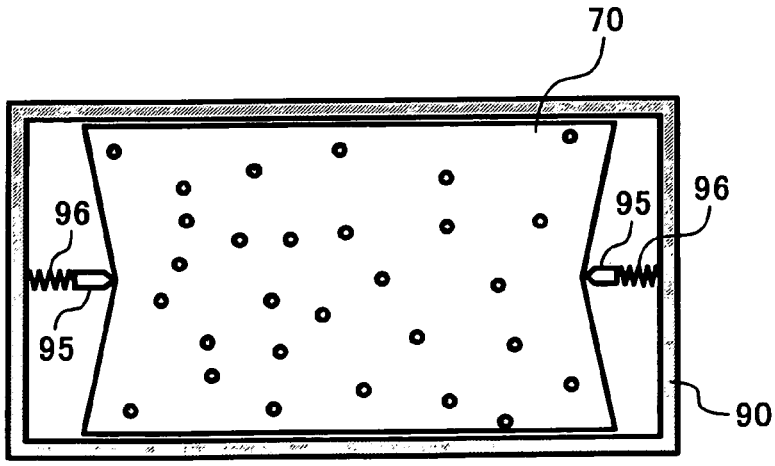
FIG. 9 is a cross-section of a toner container shown in FIG. 8.

FIGS. 8 and 9 show another alternative embodiment of the present invention. As shown, in the illustrative embodiment, a pair of regulating plates or regulating means 95 are supported by the holder 90 via coil springs 96. When a new toner container 70 is mounted to the holder 90, the regulating plates 95 are pressed against the toner container 70 under the action of the coil springs 96. As the volume of the toner container 70 decreases little by little, the regulating plates 95 move inward due to the bias of the coil springs 96 to thereby regulate the folds 73 of the toner container 70.

Figure 10:
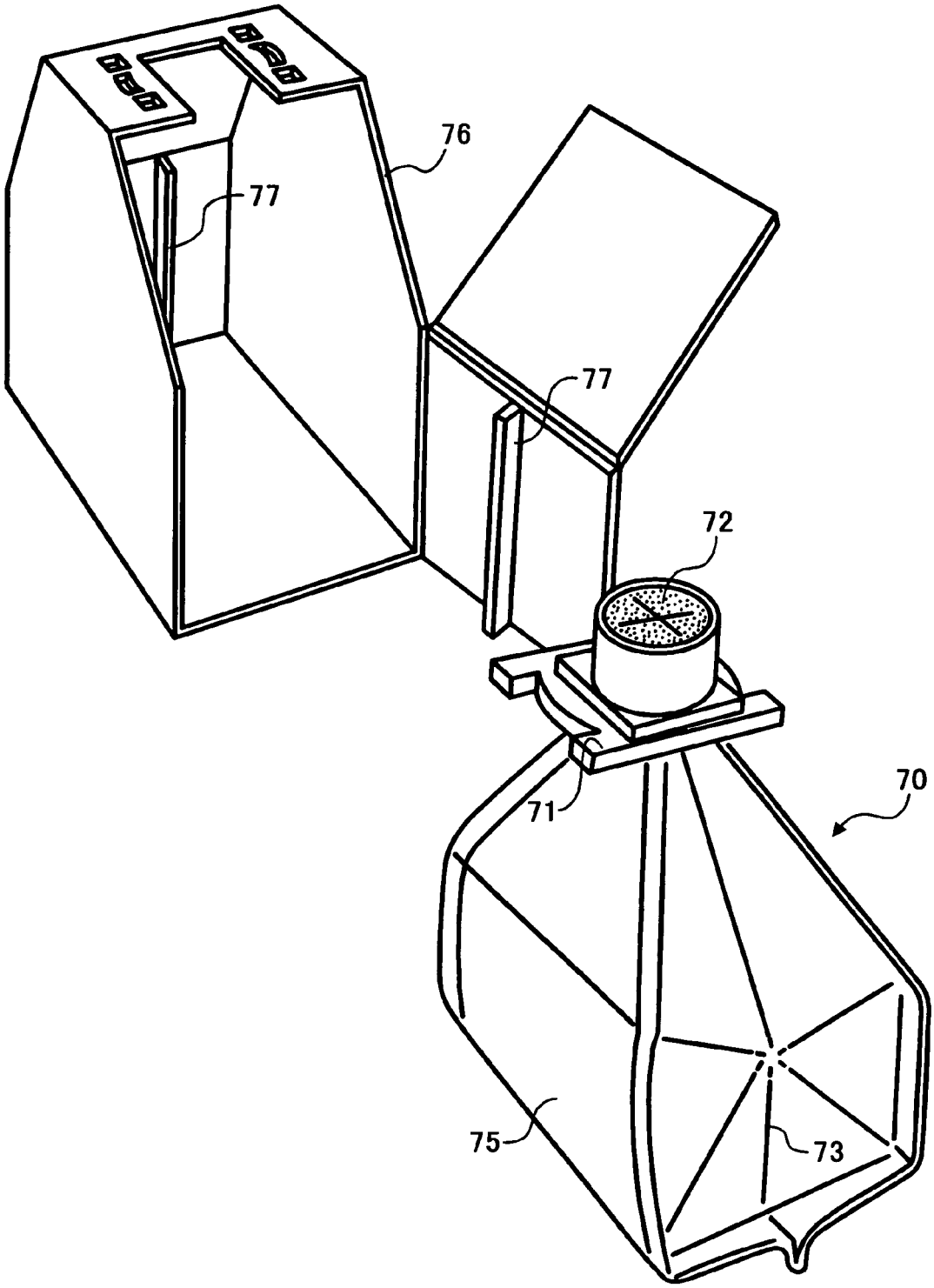
FIG. 10 is a perspective view showing another specific configuration of the toner container in accordance with the present invention.

FIG. 10 shows another specific configuration of the toner container 70. As shown, the toner container 70 has a bag-in-box type of configuration made up of a flexible bag 75 and a rigid box 76 accommodating the bag 75. After the toner container 70 has run out of the toner, the bag 75 can be removed from the box 76 and collected while the box 76 can be repeatedly used. Again, if the bag 75 is folded up in a preselected shape when removed from the box 76, then the bag 75 can be easily removed and then easily stored or transported. For this purpose, lugs or regulating means 77 are formed on the walls of the box 76 that face the folds 73 of the toner container 70.

While the embodiments shown and described have concentrated on the replenishment of toner, the present invention is capable of replenishing even a toner and carrier mixture. Further, the toner and carrier mixture may be replaced with a single-ingredient type developer, i.e., toner.

In summary, it will be seen that the present invention provides a developer container that can decrease in volume in substantially a preselected shape and can therefore be easily stored or transported while occupying a minimum of space.

Various modifications will become possible for those skilled in the art after receiving the teachings of the present disclosure without departing from the scope thereof.

What is claimed is:

1. A toner container comprising:

a bag having four side walls; and at least one fold line in each of two opposite side walls, each fold line configured to receive a regulating element at the fold line itself to fold said bag into a preselected configuration without an irregular collapse or a twisting of the bag as toner is removed from said bag and as each regulating element presses against each fold line.

2. The toner container recited in claim 1, wherein said preselected configuration is a substantially flat configuration.

3. The toner container recited in claim 1, wherein said bag is a gauzette container.

4. The toner container recited in claim 1, wherein said four side walls each comprise single-layer or laminate flexible sheets.

5. The toner container recited in claim 1, wherein said four side walls each comprise polyethylene, nylon, resin, or paper.

6. The toner container recited in claim 1, wherein said four side walls each have a thickness of 60 μm to 200 μm.

7. The toner container recited in claim 1, further comprising a mouth member affixed to an outlet of the bag.

8. The toner container recited in claim 7, wherein the mouth member further comprises a seal valve.

9. The toner container recited in claim 8, wherein the seal valve comprises sponge or rubber.

10. A toner container comprising:

a bag having four side walls; and at least one means for folding in each of two opposite side walls, each means for folding receiving means for regulating to fold said bag into a preselected configuration without an irregular collapse or a twisting of the bag as toner is removed from said bag and as each means for regulating presses against each means for folding.

11. The toner container recited in claim 10, wherein said preselected configuration is a substantially flat configuration.

12. The toner container recited in claim 10, wherein said bag is a gauzette container.

13. The toner container recited in claim 10, wherein said four side walls each comprise single-layer or laminate flexible sheets.

14. The toner container recited in claim 10, wherein said four side walls each comprise polyethylene, nylon, resin, or paper.

15. The toner container recited in claim 10, wherein said four side walls each have a thickness of 60 μm to 200 μm.

16. The toner container recited in claim 10, further comprising a mouth member affixed to an outlet of the bag.

17. The toner container recited in claim 16, wherein the mouth member further comprises a seal valve.

18. The toner container recited in claim 17, wherein the seal valve comprises sponge or rubber.

* * * * *